United States Patent [19]

Schmidt-Hatting et al.

[11] 4,124,465

[45] Nov. 7, 1978

[54] PROTECTING TUBE

[75] Inventors: Wolfgang Schmidt-Hatting; Ulrich Heinzmann, both of Chippis, Switzerland

[73] Assignee: Swiss Aluminium Ltd., Chippis, Switzerland

[21] Appl. No.: 374,461

[22] Filed: Jun. 28, 1973

[30] Foreign Application Priority Data

Jul. 18, 1972 [CH] Switzerland ..... 10748/72

[51] Int. Cl.[2] ..... C25C 3/06; C23F 13/00

[52] U.S. Cl. ..... 204/147; 204/67; 204/196; 204/243 R

[58] Field of Search ..... 204/147, 196, 243 R, 204/67

[56] References Cited

U.S. PATENT DOCUMENTS

| | | | |
|---|---|---|---|
| 476,914 | 6/1892 | Bernard | 204/196 |
| 2,311,257 | 2/1943 | Sawyer et al. | 204/196 |
| 2,508,523 | 5/1950 | Krebs | 204/196 |
| 2,834,728 | 5/1958 | Gallone | 204/147 |
| 2,918,421 | 12/1959 | Lundborg | 204/244 |

OTHER PUBLICATIONS

Evans, "The Corrosion and Oxidation of Metals," 1967, pp. 890–897.

*Primary Examiner*—T. Jung
*Attorney, Agent, or Firm*—Robert H. Bachman

[57] ABSTRACT

Method of protection of electrically conducting parts in fluoride melts through which direct current flows in the electrolysis of aluminum oxide, comprising applying such an electrical potential to said parts that the direct current flowing through the fluoride melt cannot emerge from the parts at any place within the fluoride melt.

2 Claims, 3 Drawing Figures

PROTECTING TUBE

For the recovery of aluminum by electrolysis of aluminum oxide ($Al_2O_3$, alumina) the latter is dissolved in a fluoride melt, which consists in the greatest part of cryolite $Na_3AlF_6$. This melt is contained in a cell having a carbon bottom. Anodes of amorphous carbon dip from above into the melt. Oxygen arises at the anodes by the electrolytic decomposition of the aluminum oxide, and combines with the carbon of the anodes to CO and $CO_2$. The electrolysis takes place in a temperature range of about 940° to 975° C.

In the accompanying drawings.

Figure 1:
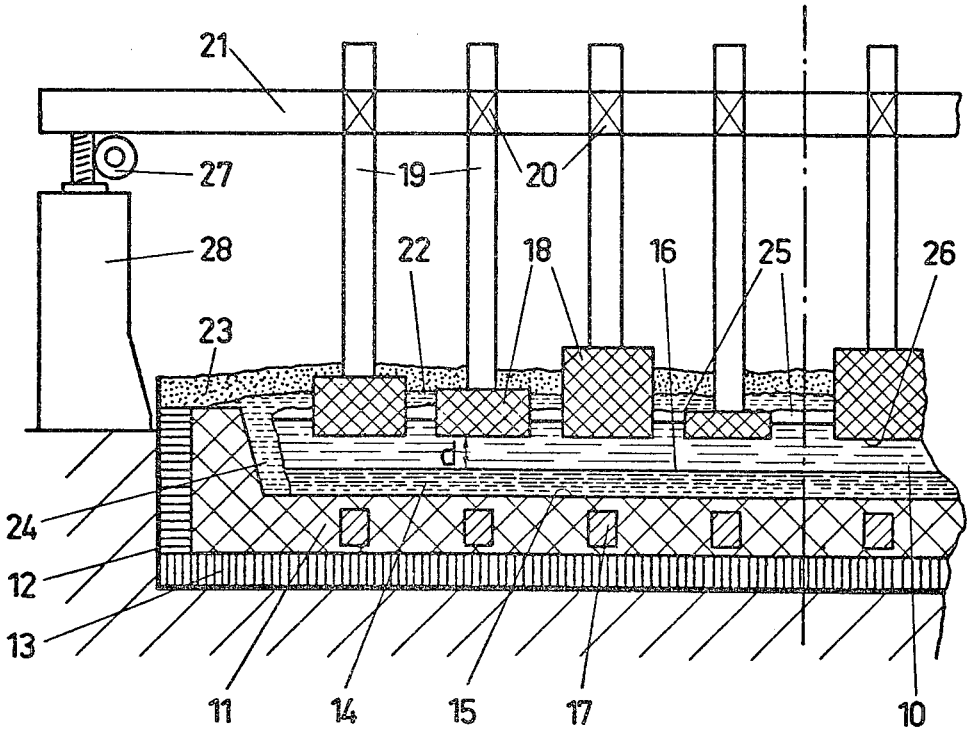
FIG. 1 is a fragmentary vertical sectional view in the longitudinal direction of an electrolysis cell.

The principle of an aluminum electrolysis cell with prebaked anodes appears from FIG. 1 of the accompanying drawing. This shows a vertical section in the longitudinal direction through part of a known electrolysis cell.

The steel shell 12, which is lined with a thermal insulation 13 of heat-resisting, heat-insulating material and with carbon 11, contains the fluoride melt 10 (the electrolyte). The aluminum 14 separated at the cathode lies on the carbon bottom 15 of the cell. The surface 16 of the liquid aluminum constitutes the cathode. In the carbon lining 11 there are inserted iron cathode bars 17 transverse to the longitudinal direction of the cell, and these conduct the electrical direct current from the carbon lining 11 of the cell laterally outwards. Anodes 18 of amorphous carbon dip from above into the fluoride melt 10, and supply the direct current to the electrolyte. They are firmly connected via conductor rods 19 and clamps 20 with the anode beam 21. The current flows from the cathode bars 17 of one cell to the anode beam 21 of the following cell through conventional current bus bars, not shown. From the anode beam 21 it flows through the conductor rods 19, the anodes 18, the electrolyte 10, the liquid aluminum 14, and the carbon lining 11 to the cathode bars 17. The electrolyte 10 is covered with a crust 22 of solidified melt and there is a layer of aluminum oxide 23 lying above the crust. In operation, cavities 25 occur between the electrolyte 10 and the solidified crust 22. Against the side walls of the carbon lining 11 there likewise forms a crust of solid electrolyte, namely a lateral ledge 24. The horizontal extent of the lateral ledge 24 affects the plan area of the bath of liquid aluminum 14 and electrolyte 10.

Because of attack by the oxygen released during electrolysis, the anodes are consumed continuously on their lower side, by about 1.5 to 2 cms per day according to the type of cell.

Thus each anode is gradually consumed, and the effect of this would be to increase the distance *d* from the lower side of the anode to the surface of the aluminum, also known as the interpolar distance. This distance can be adjusted by lifting or lowering of the anode beam 21 with the help of lifting mechanism 27, which is mounted on pillars 28. This affects all the anodes. An anode can be adjusted individually by releasing the respective clamp 20, shifting the respective conductor rod 19 upwards or downwards relatively to the anode beam 21, and re-tightening the clamp.

When an anode has been consumed, then it is exchanged for a fresh anode. In practice, the anodes are not consumed at exactly equal rates, and so they are not exchanged at the same time. For this reason, anodes of different starting date operate together in the same cell, as appears from the drawing.

The principle of an aluminum electrolysis cell with self-baking anodes (Soederberg anodes) is the same as that of an aluminum electrolysis cell with pre-baked anodes. Instead of pre-baked anodes, anodes are used which are continually baked from a green electrode paste in a steel jacket during the electrolytic operation by the heat of the cell. The direct current is supplied by lateral steel rods or from above by vertical steel studs. These anodes are renewed as required by pouring green electrode paste into the steel jacket.

By breaking in of the upper electrolyte crust 22 (the crusted bath surface), the aluminum oxide 23 which is above it is brought into the electrolyte 10. This operation is known as servicing of the cell. In the course of the electrolysis, the electrolyte becomes depleted in aluminum oxide. When the concentration of aluminum oxide in the electrolyte falls to somewhere between 1 and 2%, there arises the anode effect, which results in a sudden increase in cell voltage from the normal 4 to 4.5 volts to 30 volts and above. Then at the latest the crust must be broken in, and the $Al_2O_3$ concentration be raised by addition of new aluminum oxide.

The aluminum 14 produced electrolytically, which collects on the carbon bottom 15 of the cell, is generally removed once a day from the cell by conventional tapping devices, for instance sucking devices.

For an automatic supervision and control of the aluminum electrolysis cells, computers are installed which analyse the condition of each cell from various measured values such as electrolyte temperature (temperature of the fluoride melt) $Al_2O_3$ concentration, behaviour of the electrical resistance of the cell as a function of the time, behaviour of the electromotive force (EMF) as function of the time, etc., and deliver corresponding logical commands to automatically operating machines (automatic crust breakers, devices for suppressing anode effects, $Al_2O_3$ loading devices etc.).

In an analysis of cells, certain values are extraordinarily important; without their measurement continuously or quasicontinuously, a fully automatic control of the cells is not possible. These values are: interpolar distance, $Al_2O_3$ concentration in the electrolyte, electrolyte temperature, voltage drop in the cell bottom, electrolyte composition (composition of the fluoride melt), and dimensions of the liquid bath (metal and electrolyte).

For the detection of certain of these values devices are necessary which come into contact with the fluroide melt through which direct current flows and which are not parts of the normal cell design, but are immersed into the fluoride melt for special purposes (for instance measuring devices). All the parts which come into contact with the fluoride melt must have a through corrosion resistance against this, inasmuch as they must remain operable in contact with it, e.g. for a week or more. If the parts extend out of the surface of the fluoride melt, they must also be resistant to oxygen.

All the parts of the devices which come into contact with the fluoride melt through which direct current flows should consist of a material which is not electrically conducting and which is resistant against the fluoride melt and against oxygen. Such a material is so far not known.

On the other hand there exist materials which are electrically conducting and resistant against liquid aluminum, but not resistant against oxygen, e.g. graphite or titanium boride ($TiB_2$), also $TiB_2$ in association with boron nitrate (BN) and/or aluminum nitride (AlN). If parts of material which is electrically conducting and also resistant against the fluoride melt and against liquid aluminum are immersed in the fluoride melt through which direct current flows, they operate therein as bipolar electrodes; the direct current enters at one place on the part and leaves at another place on the part. The current entry place is cathode, at which in consequence metallic aluminum is separated out, while the current exit place operates as anode, at which nascent oxygen arises. The oxygen destroys the material, since the latter is not resistant to oxygen.

It follows from the foregoing that materials which are not resistant against liquid aluminum, such as platinum, cannot be employed for manufacture of parts of devices which come into contact with the fluoride melt through which direct current flows.

The invention relates to a method of protection of parts made of materials which are electrically conducting, resistant against the liquid fluoride melt and against liquid aluminum, but not resistant to oxygen, in fluoride melts through which direct current flows.

In the method according to the invention, such an electrical potential is applied to the parts in question, that the direct current flowing through the fluoride melt cannot emerge from the parts at any place within the fluoride melt. In consequence, within the fluoride melt the direct current can only enter into the part: the entire contact surface between the parts and the fluoride melt operates as cathode. The liquid aluminum which is then separated out at the contact surface drains off and arrives in the liquid aluminum which accumulates on the bottom of the electrolysis cell.

As regards the electrical potential, it does not suffice that this is only slightly negative with respect to the one or more anodes of the cell: the danger exists that this only slightly negative potential will indeed increase the cathodically operating surface of the part, but not cause the anodically working surface to vanish. The electrical potential must, with respect to the one or more anodes on the cell, be negative to such an extent that the entire surface of the part immersed in the fluoride melt operates as cathode. It has been established that the electrical potential of the protective housing must be more negative than the cathode of liquid aluminum of the same cell.

If for example, the potential difference between the one or more anodes on the one hand and the liquid aluminum cathode on the other hand amounts to 3.2 volts, the potential difference between the one or more anodes on the one hand and the immersed parts on the other hand must be greater than 3.2 volts, e.g. 5.5 to 6 volts. This can, for example, be achieved in practice in that the parts to be protected are connected to the potential of the cathode of the following cell through an adjustable protective resistance. If one choses a still more negative potential, the protective resistance must be increased and designed for a higher duty. In practice it is sufficient if the electrical potential on the parts to be protected is more negative by 2 to 3 volts than on the cathode of liquid aluminum of their own cell.

A significant use of the invention relates to the protection of protective tubes for thermoelements for the continuous measurement of the temperature of the fluoride melt.

In practice the temperature of the fluoride melt lies between 940° and 975° C. During the anode effect or during disturbances in cell operation still higher temperatures occasionally arise. The temperature of the fluoride melt should be as low as possible, i.e. between 975° and 945° C. If it is likely to fall below 945° C., the fluoride melt locally turns out to be below the liquidus point; solid components separate and sink to the bottom of the cell, where they can give rise to disturbing bottom sludge and bottom incrustations. Thereupon the current efficiency falls, and the specific electrical energy consumption rises. On the other hand above 975° C. the solubility of the aluminum in the electrolyte significantly rises. The metal dissolved in the electrolyte is reoxidised by the anode gases, which consist substantially of $CO_2$, which likewise can lead to a significant impairment of the operating values mentioned. In order to maintain the temperature of the fluoride melt in the desired range, the energy supply to the cell is varied by means of the cell voltage. Since hitherto it was not possible to measure the temperature of the fluoride melt continuously, it was left more or less to the experience of the operating personnel to estimate this temperature according to the colour of the radiation produced and the colour of the exhaust gas flame. Defective estimates are unavoidable in this. The temperature measurement in the fluoride melt occurs usually by means of thermoelements. These thermoelements must be surrounded by a protective tube, because the electrolyte is chemically very corrosive, and furthermore by contact with the wires of the thermoelement the measurement would be strongly falsified, the more so in that the fluoride melt is flowed through by direct current.

A steel or cast iron tube of large wall thickness is often used as protective casing. For discontinuous measurements the attack by the fluoride melt is bearable; the protective tube must be frequently exchanged. The large wall thickness, which must be penetrated by heat flow, has the effect that a relatively long time elapses before the measurement is available. On the other hand, with employment of steel and cast iron tubes a continuous measurement over longer periods of time is not possible; the protective tube together with the thermoelement introduced into its interior would be previously destroyed.

In a long series of experiments it has been established that materials which are electrically conducting and thoroughly resistant to the fluoride melt, but not resistant to oxygen, can be employed for the manufacture also of thin-walled protective tubes, if, according to the invention, care is taken by means of an electrical potential that the electrolysis direct current cannot emerge at any point into the fluoride melt from the protective tube, but on the contrary only enters all over its immersed surface.

Figure 2:
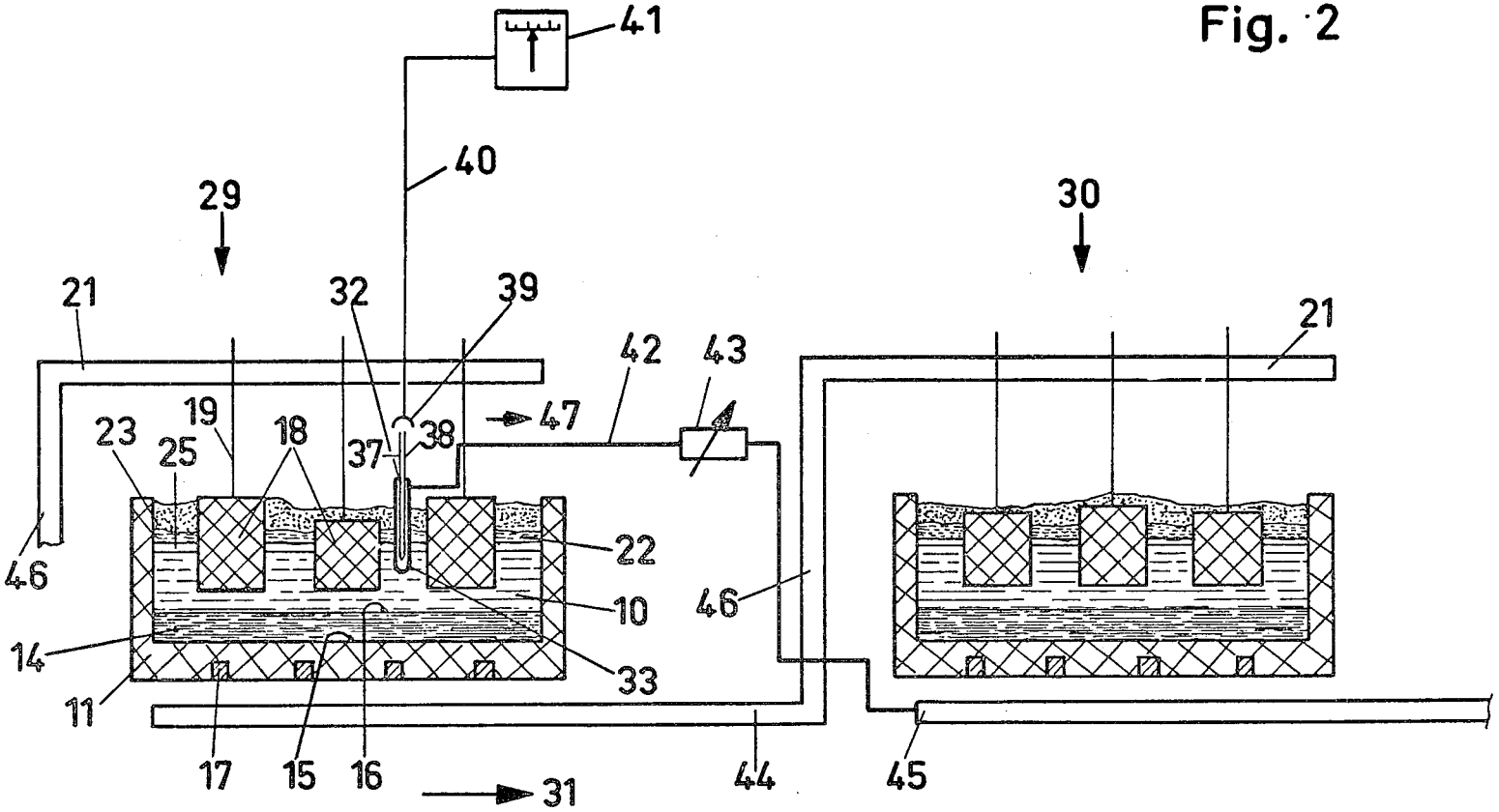
FIG. 2 is a schematic sectional view of two aluminum electrolysis cells connected in series.
Figure 3:
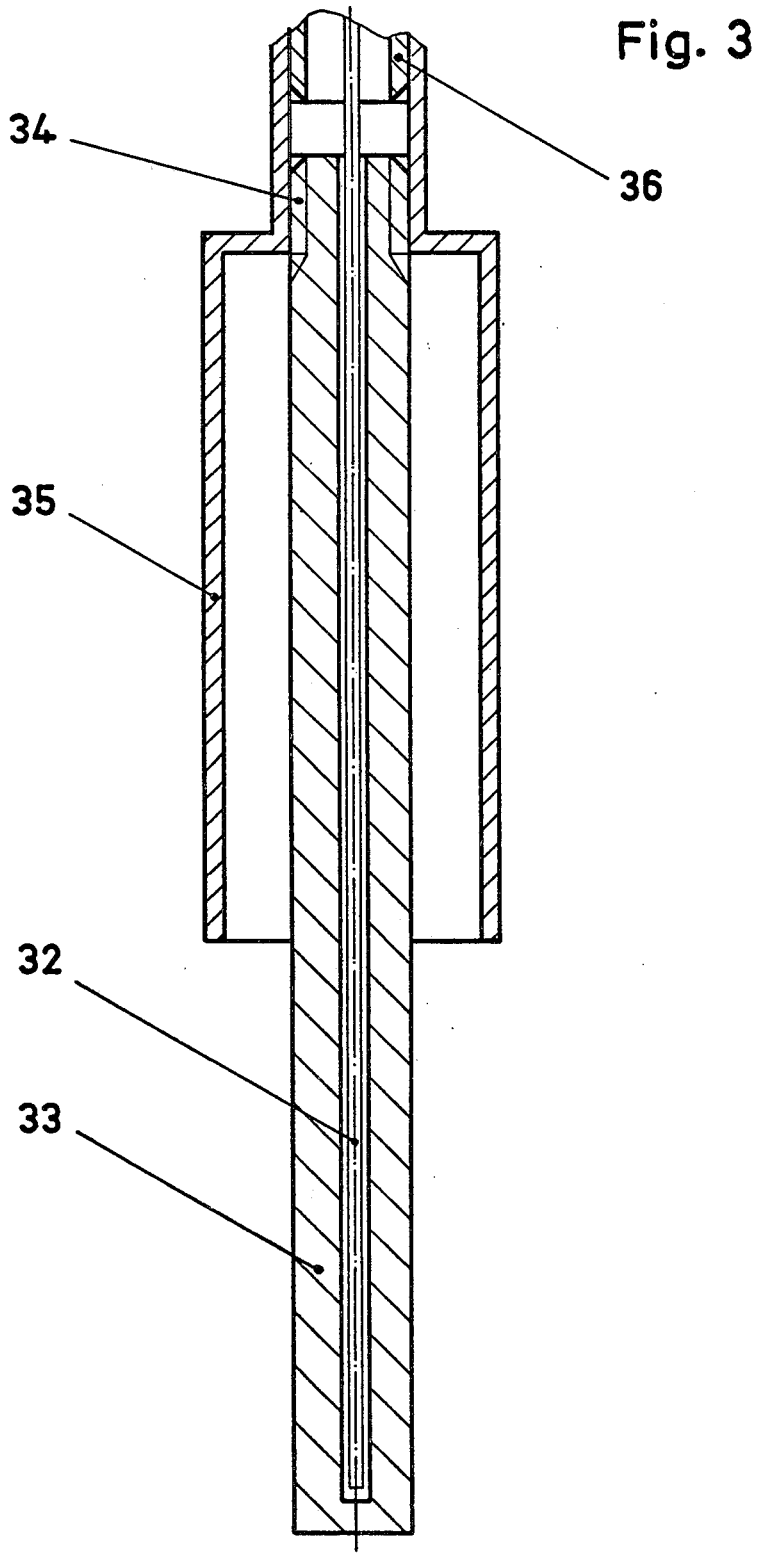
FIG. 3 is a large scale fragmentary sectional view of a thermoelement with protective tube.

FIGS. 2 and 3 illustrate as an example the employment of the method according to the invention with the protective tube of a thermoelement for the measurement of the temperature of the fluoride melt 10 of an electrolytic cell for the recovery of aluminum, of the kind shown in FIG. 1.

FIG. 2 shows, purely schematically, two aluminum electrolysis cells connected in series, and FIG. 3 the thermoelement with protective tube in longitudinal section substantially full size. The electrolysis cells are indicated at 29 and 30. The arrow 31 indicates the general direction of the direct current. Cell 30 is the following cell to cell 29.

For the sake of clarity there are not shown the steel shell 12 (compare FIG. 1), the thermal insulation 13, the clamps 20, the lifting mechanisms 27 and the pillars 28. The carbon casing 11, the conductor rods 19 and the crust 22 of solidified melt with laterial ledge 24 are more schematically shown than in FIG. 1. The cathode bars 17 carry the current via conventional electrical connections not shown to the indicated cathode rails 44, 45 respectively; the electrical connection with the anode beams 21 occurs through conventional rising conductors 46.

The thermoelement 32 (FIG. 3) consists, for example, of chromel-alumel wires or nickelchrome — nickel wires, which are embedded in an electrically insulating sheath of very small diameter (e.g. 2mm) of ceramic material. Such elements are available in commerce. The thermoelement 32 is inserted with its lower part, at the end of which is the junction, in a protective tube 33 of graphite of about 20 mm external diameter. In the upper part the protective tube 33 has an external thread 34, by which it is screwed into a sheath 35. The sheath 35 here consists of steel, has an external diameter of 50 mm and a wall thickness of 3 mm. It serves to protect the protective tube 33 against impacts and blows, for example, during crust breaking and is omitted in FIG. 2 for the sake of clarity.

A steel tube is numbered 36, which likewise is screwed into the sheath 35. This steel tube 36 is omitted in FIG. 2 for clarity. It need not reach to the surface of the liquid electrolyte 10. The protective tube 33 of graphite is electrically connected with the steel tube 36 through the sheath 35 of steel, so that it is possible to connect it in accordance with the invention to a source of direct current via the sheath 35 or the steel tube 36.

In FIG. 2 the temperature measuring device with thermoelement and protective tube is shown for simplicity without sheath 35 and without steel tube 36, which are not necessary to illustration of the method. The two wires 37 and 38 of the thermoelement 32 are connected in the usual manner through a junction box 39 and through balancing line 40 with a measuring device 41 for the thermoelectric voltage, e.g. with a digital voltmeter or a compensator.

In order to apply the desired potential to the protective tube 33, one connects this electrically through a lead 42 and an adjustable and overloadable protective resistance 43 to the cathode rail 45 of the following cell 30. The arrow 47 shows the direction of the protective direct current.

The protective resistance 43 serves for limitation of the protective direct current. It should be so adjusted that the potential on the protective tube 33 with a freely definable protective current is more negative than the potential of the liquid aluminum of the same cell, e.g. about 2 volts more negative. For example with a 100,000 amp cell one choses a protective current intensity of about 5 to 10 amps.

The method is, of course, not restricted to the protection of protective tubes of thermoelements. For example any holders or housings of measuring probes can be protected in the same way, which come into contact with the electrolyte flowed through by direct current and serve, for exmaple, to measure the $Al_2O_3$ concentration, the potential difference etc. For example, there comes in question the protection of the housing 36 of the reference electrode 34 in U.S. Pat. No. 3,578,569 of Kaiser Aluminum and Chemical Corporation.

What is claimed is:

1. A method for protection of pieces to be inserted into an operating fluoride melt electrolysis cell normally used for recovery of aluminum from aluminum oxide, wherein direct current is flowing through the fluoride melt between an anode and a cathode, as is normally used for recovery of aluminum from aluminum oxide, the insertion of said pieces into the operating cell being for special purposes such as for use as a sheathing for measuring devices, said pieces being made of an electrically conductive material which is resistant against reaction with melted fluoride and melted aluminum but not resistant against reaction with oxygen, especially the oxygen which forms in the operating cell on a portion of the piece in contact with the melt due to differences in potential that form across said piece when inserted into an operating cell; comprising the steps of applying an electrical potential between said piece and said cell, said potential being of such magnitude and polarity as to prevent direct current from emerging from said piece at any place within the melt and maintaining, substantially, said electrical potential.

2. In a method for protection of a protective casing for use in connection with an operating electrolytic cell of the type used for recovery of aluminum from aluminum oxide having a molten aluminum layer which acts as the cathode and a fluoride melt electrolyte into which the protective casing is immersed, whereby portions of the protective casing are in contact with the melt, said protective casing being made from materials resistant against reaction with the melt and with molten aluminum, but non-resistant against reaction with oxygen under the conditions found in the cell;

the steps comprising, maintaining an electrical potential difference between said protective casing and said cathode of such magnitude and polarity as to maintain said protective casing at an electrical potential more negative at all points in contact with said melt, than said cathode thereby inhibiting the formation of oxygen at the surface of the protective casing.

* * * * *